United States Patent [19]

Hilzinger et al.

[11] 4,386,648

[45] Jun. 7, 1983

[54] METHOD AND DEVICE FOR MANUFACTURE OF AMORPHOUS METAL TAPES

[75] Inventors: Hans-Reiner Hilzinger, Maintal; Kurt Krueger, Ronneburg; Stefan Hock, Hanau, all of Fed. Rep. of Germany

[73] Assignee: Vacuumschmelze GmbH, Fed. Rep. of Germany

[21] Appl. No.: 186,141

[22] Filed: Sep. 10, 1980

[30] Foreign Application Priority Data

Sep. 25, 1979 [DE] Fed. Rep. of Germany ..... 2938709

[51] Int. Cl.[3] ..... B22D 11/06

[52] U.S. Cl. ..... 164/463; 164/423

[58] Field of Search ..... 164/463, 479, 488, 423, 164/427, 437

[56] References Cited

U.S. PATENT DOCUMENTS 4,142,571 3/1979 Narasimhan ..... 164/88

4,257,830 3/1981 Tsuya et al. ..... 164/463 X

FOREIGN PATENT DOCUMENTS 2746238 4/1978 Fed. Rep. of Germany .

*Primary Examiner*—Gus T. Hampilos

*Attorney, Agent, or Firm*—Hill, Van Santen, Steadman, Chiara & Simpson

[57] ABSTRACT

Amorphous metal tapes are produced by expressing a metallic melt in a supply container through at least one nozzle opening onto a moving surface of a cooling body positioned in relatively close proximity to the nozzle opening. The nozzle opening is 1.5 through 6 mm wide, as measured in the direction of motion of the cooling body surface, which is positioned at a distance of about 0.005 through 0.6 times the width of the nozzle opening from such opening and is moved at a velocity of at least 5 meters per second past such nozzle opening.

7 Claims, 3 Drawing Figures

FIG. 1
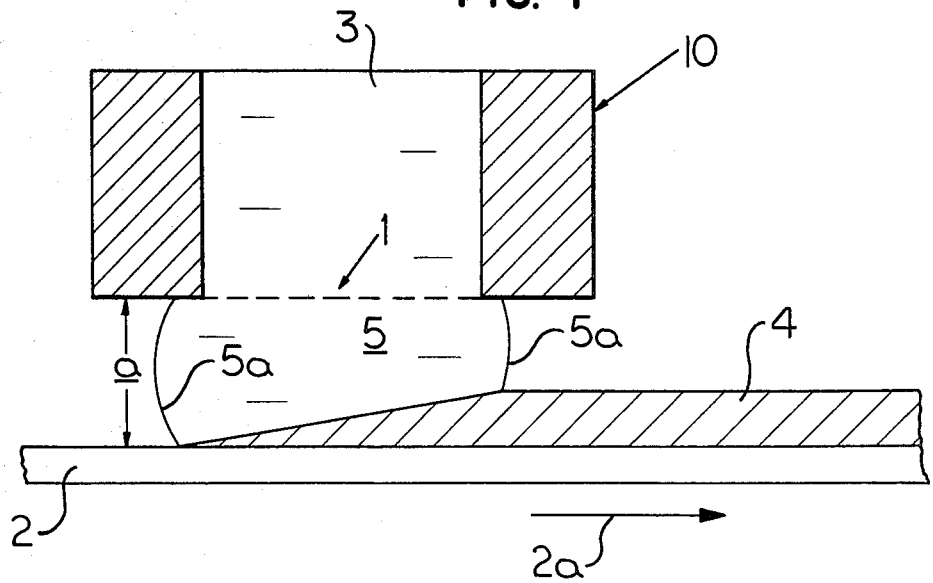
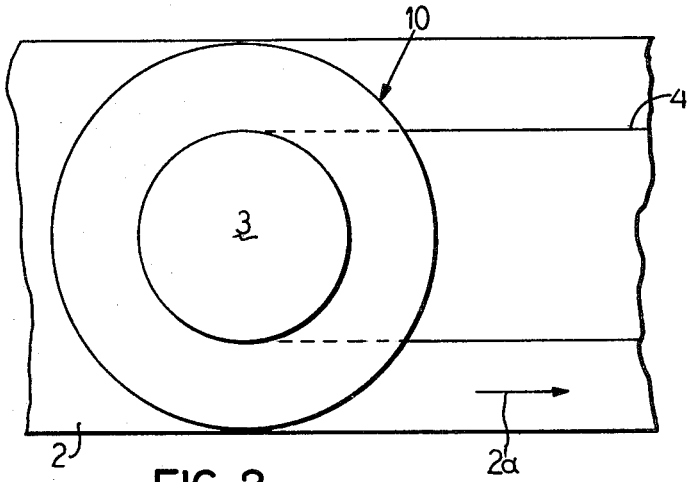
FIG. 2

METHOD AND DEVICE FOR MANUFACTURE OF AMORPHOUS METAL TAPES

BACKGROUND OF THE INVENTION

1. Field of the Invention

The invention relates to amorphous metal tapes and somewhat more particularly to a method and device for manufacture of amorphous metal tapes.

2. Prior Art

Methods of manufacturing amorphous metal tapes directly from a suitable metal melt are known. Amorphous tapes are produced by quickly quenching a suitable metal melt at a velocity of about $10^4$ through $10^{6°}$ K./s so that solidification without crystallization occurs. In these processes, molten amorphous metal alloys are typically extruded under pressure through one or more nozzle openings and the emerging molten metal stream is directed against a moving cooling surface. For example, the inner or outer surface of a rotating drum or of a travelling endless belt can be utilized as a cooling surface. The thickness of a tape obtained in this manner can, for example, amount to a few hundredths of a millimeter and the width can amount to a few millimeters and up to several centimeters.

Amorphous metals or alloys can be distinguished from crystalline metals or alloys by X-ray difraction measurements. In contrast to the crystalline materials, which exhibit characteristic sharp difraction lines, the intensity in X-ray difraction images of amorphous metal alloys changes only slowly with the difraction angle, somewhat similar to liquids or common glass.

Depending on the manufacturing conditions, tapes produced from amorphous alloys can be completely amorphous or can comprise a two-phase mixture of the amorphous and the crystalline states. In general, the phrase "amorphous metal alloy", as used in this art and in the instant specification and claims, defines an alloy whose molecular structure is at least 50 percent and preferably at least 80 percent amorphous.

It is already known to utilize round nozzle openings having a diameter of 0.5 through 1 mm in the manufacture of very narrow amorphous metal tapes. With this type of nozzle opening, a molten metal stream is expressed through such opening and strikes a moving surface of a cooling body after a free path of about 1 through 20 mm and expands thereon into a stationary molten drop. The desired metal tape grows from the underside of such drop due to advancing solidification. However, this process cannot be transferred without further ado, for example, for use with larger nozzle openings required to manufacture wider metal tapes because the tape geometry depends very greatly on the dimensions of the molten drop. With nozzle openings which are too large, the molten drop becomes too long and thus unstable at a correspondingly higher velocity of the cooling body surface. Further, the tape quality is adversely affected by all oscillations and the like in the free molten metal drop. The smooth and uniform surfaces required in broader tapes, as well as a uniform thickness and width over the entire length of a tape cannot be achieved with this technique.

German Offenlegungsschrift No. 27 46 238 suggests another method for producing amorphous metal tapes. In this process, a slotted nozzle connected to a supply container or crucible for molten metal is positioned in direct proximity, for example, at a distance of 0.03 through 1 mm, of a surface of a suitable cooling body.

The width of the nozzle slot, as measured in the direction of motion of the cooling surface, is about 0.2 to a maximum of 1 mm. The width of the nozzle edges at both sides thereof are said to be particularly critical. The first edge, positioned in the direction of motion of the cooling surface, has a width which is at least equal to the width of the slot while the width of the second edge is about 1.5 through 3 times the width of the slot. Additionally, the distance between the nozzle opening and the cooling surface ranges between a 0.2 multiple to a 1 multiple of the slot width. With such parameters, the molten metal stream expressed from such nozzle opening forms a solidification front upon contact with the moving surface of the cooling body and such front passes directly past the second edge of the nozzle without contact. The flow velocity of the molten metal is primarily controlled by the viscous flux between the first edge of the nozzle and the solidified metal tape. However, nozzles with such small dimensions require extremely pure melts. Otherwise, there is a danger that the nozzle opening will be blocked due to incompletely dissolved or prematurely solidified particles of the melt. In addition to the relatively low production rates which are generally attained with narrow nozzle openings, a further disadvantage of this technique is that a significantly greater processing outlay is required in order to produce such narrow nozzle openings with the appropriate tolerances.

SUMMARY OF THE INVENTION

The invention provides a method and device for producing uniform amorphous metal tapes at higher production rates and with greater tolerances for melt purity and greater tolerances for nozzle opening dimensions, in comparison to the prior art.

In accordance with the principles of the invention, amorphous metal tapes are produced by expressing a molten metallic stream from a supply crucible through at least one nozzle opening onto a moving surface of a cooling body positioned in direct proximity of the nozzle opening.

In preferred method embodiments of the invention, the surface of the cooling body is positioned at a distance of about 0.005 through 0.6 times the width of the nozzle opening, which is 1.5 through 6 mm wide, as measured in the direction of motion of the cooling body surface, which moves past the nozzle opening at a velocity of at least 5 m/s.

Preferred device embodiment of the invention comprise a combination of (a) a cooling body having a surface which rotates at least around one axis thereof, and (b) at least one nozzle opening positioned in relatively close proximity to such surface. The nozzle opening is in fluid communication with a supply crucible or container containing a select metallic melt and is formed so as to have a width dimension of 1.5 through 6 mm. The distance between the nozzle opening and the surface of the cooling body is adjusted so as to range between about 0.005 through 0.6 times the width of the nozzle opening and the surface of the cooling body is caused to travel past the nozzle opening at a rate of at least 5 m/s.

In contrast to previously known techniques for producing amorphous metal tapes, the method and device embodiments of the invention are distinguished by a combination of nozzle opening width dimension ranges, a range of distances between the nozzle opening and the surface of the cooling body as well as a minimum velocity for the moving surface of the cooling body, all of which are particularly advantageous. By following the principles of the invention, particularly uniformly formed metal tapes are readily attained at higher production rates than available with prior art parameters.

Further, as was unexpectedly discovered, the substantially wider nozzle openings utilized with the practice of the invention, are of significant advantage in that the form of the nozzle is less decissive on the tape geometry and is less sensitive to blockage or premature closing, while operating at correspondingly lower pressures on the melt. The particular parameters preferably selected, respectively depend on the desired width or the thickness of the metal tape being produced. In certain preferred embodiments, the surface of the cooling body is moved past the nozzle opening, which in preferred embodiments is 2 through 4 mm wide, at a velocity of about 20 through 40 m/s at a distance of less than about 0.1 times the width of the nozzle opening, from such opening.

However, if a nozzle opening significantly wider than 6 mm is used, only correspondingly thicker tapes can be produced because of the greater amount of melt striking the surface of the cooling body. This also is interrelated to the fact that technical limits are encountered for heat dissipation from such larger amount of melt via the surface of the cooling body. It is therefore assumed that with nozzle openings which are significantly wider than 6 mm, problems could occur with the necessary cooling of the cooling body or with the amorphous structure of the tapes being produced.

Although, as previously mentioned, the precise shape of a nozzle opening within the principles of the invention is less decissive on tape geometry, given a width greater than 1.5 mm, is preferable to utilize nozzle openings having cross-sections which are circular or nearly circular. Nevertheless, other nozzle opening cross-section, for example, nozzle openings having rectangular or other geometrically shaped cross-sections can be employed, as well as multiple nozzles having the same or different cross-sections. With the wider nozzle openings utilized in accordance with the principles of the invention, such nozzles are significantly simpler to produce because of reduced demands made on the dimension tolerances.

In practicing the invention with nozzle openings having a width above 2 mm, the melt, normally, can no longer be prevented from prematurely discharging solely by surface tension, which is overcome by the pressure of the intrinsic weight of the melt within such relatively wide opening. In particular, when the height of the molten melt is greater than 4 cm above the nozzle opening, it is preferable to provide a plug member for closing the nozzle opening. The plug member is moveable in the melt supply crucible when the melt is being expressed. Given a round nozzle opening, the protective tube of a thermocouple immersed in the metallic melt can preferably be utilized as such a plug member. Even with other nozzle shapes, for example such which have a rectangular or the like opening cross-section, the thermocouple protective tube can be advantageously utilized as a moveable plug member, with appropriate adaptations of the protective tube shape to the particular nozzle opening utilized. However, it is not essential that the plug member be connected or associated with a thermocouple immercible into the metallic melt; plug members which are completely independent of the protective tube and/or the thermocouple can also be utilized.

BRIEF DESCRIPTION OF THE DRAWINGS

FIG. 1 is an elevated, partial and schematic view of only essential elements necessary for the practice of the principles of the invention.

FIG. 2 is a top plan of an exemplary nozzle opening useful in the practice of the invention.

DESCRIPTION OF PREFERRED EMBODIMENTS

Figure 3:
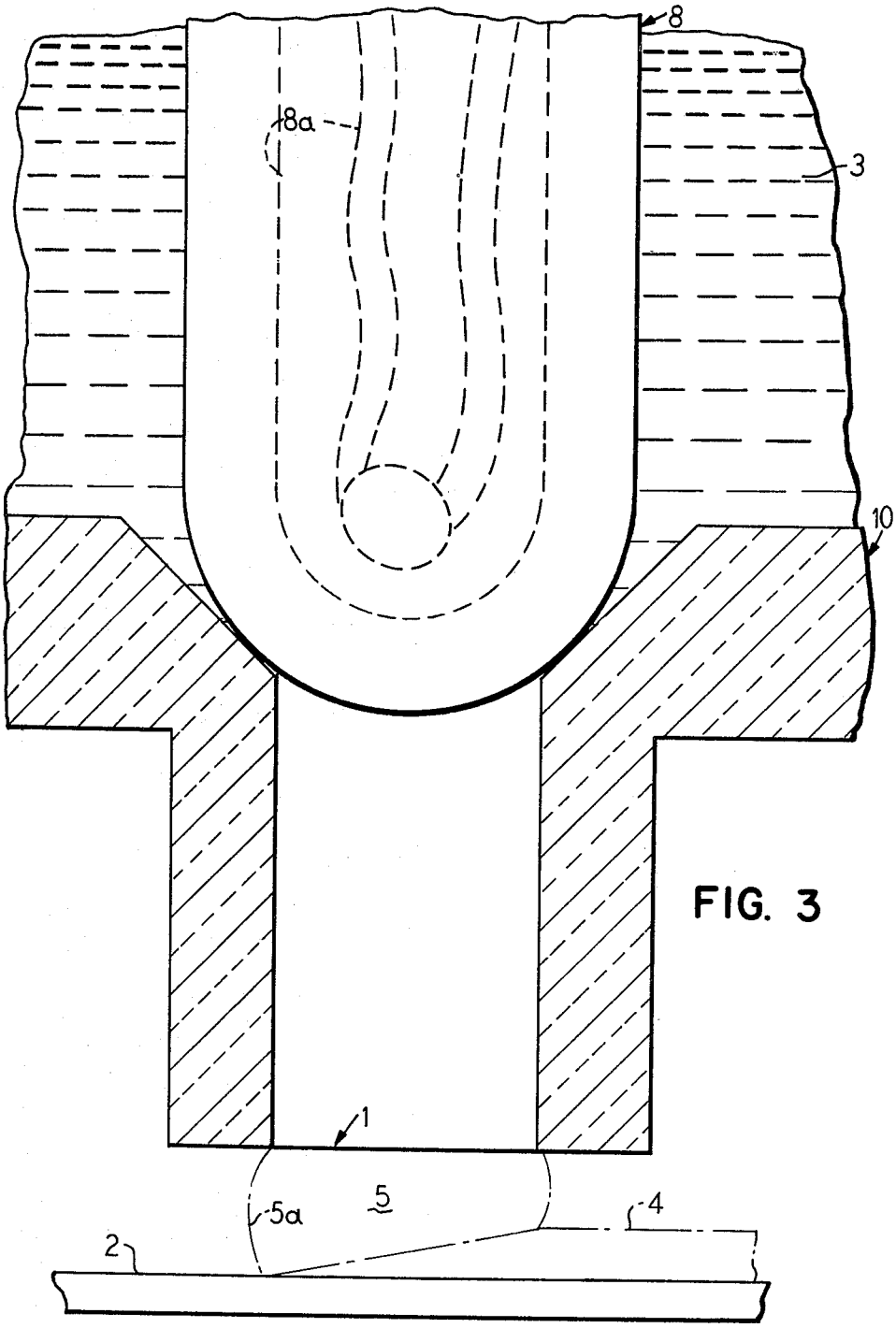
FIG. 3 is partial schematic view somewhat similar to FIG. 1 but illustrating another embodiment of the invention.
Figure 4:
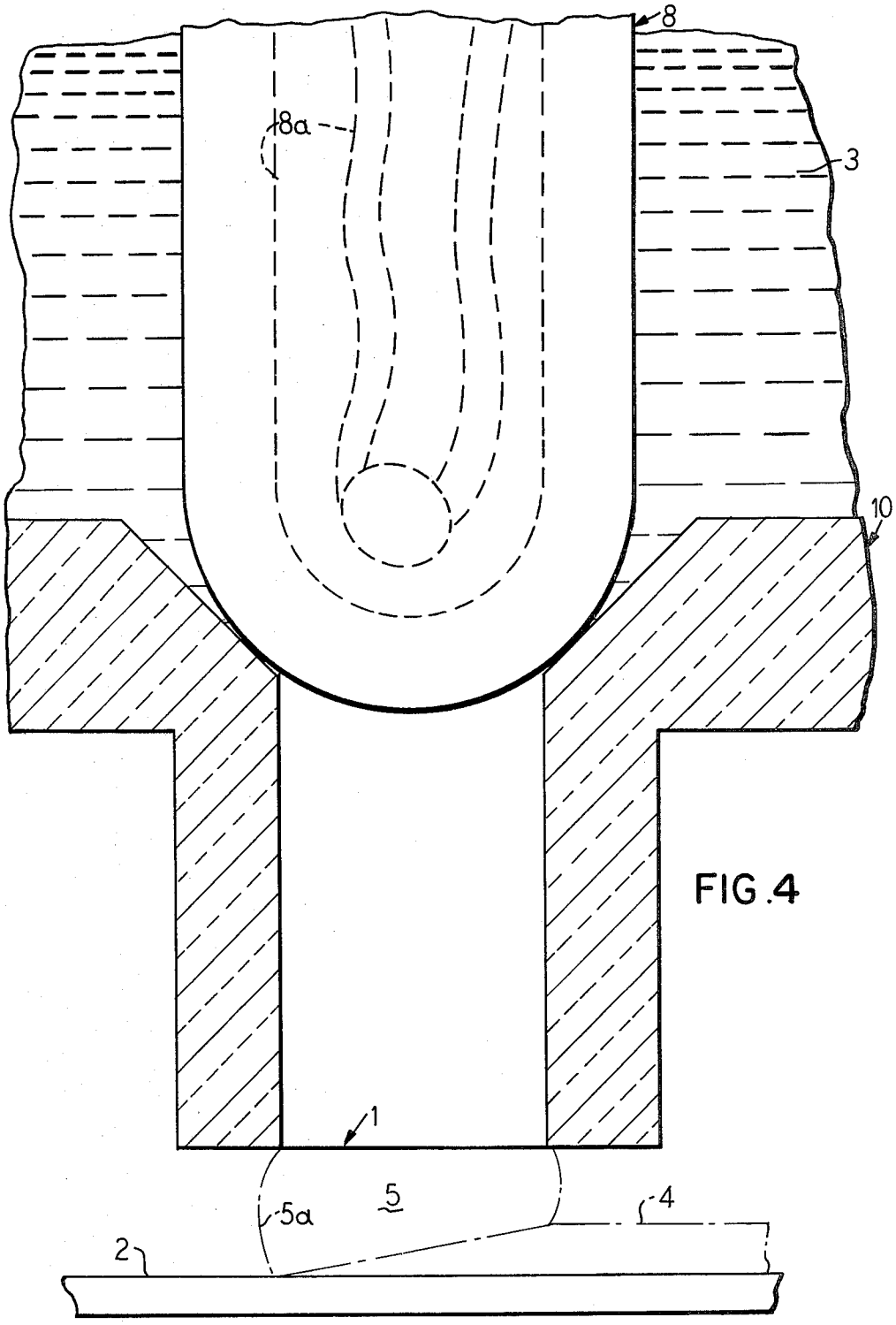

As shown in FIG. 1, a nozzle 10 is provided with a nozzle opening 1 which is positioned in direct proximity to a moving cooling body surface 2. The surface 2 travels in a direction of arrow 2a. Molten metal 3 from a suitable supply crucible or container (not shown), within nozzle 1 is expressed, preferably via an inert gas, so that a molten drop 5 of metal is formed on the moving surface 2 of the cooling body. A metal tape 4 grows at the underside of such molten drop due to its advancing solidification. In accordance with the principles of the invention, it is of decisive significance that the width of the nozzle opening 1, as measured in the direction of motion to cooling body surface 2, is greater than the distance a between the nozzle opening and the surface 2 of the cooling body. The lateral expanse of the molten drop, determined by the limiting surfaces 5a, is controllable by the discharge pressure used in expressing the molten drop 5 and by the distance a. Given a very small a dimension, for example in the range of about 0.1 through 0.2 mm, the expansion of the molten drop is approximately equal to the width of the nozzle opening 1, as measured in the direction of motion of the cooling body surface 2. In addition to the velocity of the cooling body surface 2, the expanse of the molten drop primarily determines the thickness of the amorphous metal tape being produced. An additional factor influencing the tape thickness is the solidification rate of the molten metal which depends, on the one hand, on the thermal conductivity of the cooling body material and, on the other hand, on the coefficient of heat transmission between the solidified tape 4 and the surface 2 of the cooling body. Overall, it has been noted that tape thickness is increased with increasing thermal conductivity of the cooling body material, increasing width of the nozzle opening as well as a decreasing velocity of the moving cooling body surface.

With the foregoing general discussion in mind, there is now presented detailed examples which will illustrate to those skilled in the art the manner in which this invention is carried out. However, the examples are not to be construed as limiting the scope of the invention in any way.

EXAMPLE 1

An alloy having the composition $Fe_{40}Ni_{40}B_{20}$ was obtained for the production of an amorphous metal tape. This alloy exhibited a melting temperature of approximately 1050° C. 500 grams of this alloy were inductively heated in a suitable supply crucible or container composed of a quartz glass to a temperature approximately 50° to 100° C. above the melting point thereof. The nozzle attached to the lower end of the supply crucible had an opening with a circular cross-section as shown at FIG. 2 and a diameter of 2.5 mm. During the heating, a moveable plug member (which can be a moveable plug member 8 having a thermocouple 8*a* therein as shown in FIG. 3) was immersed into the metallic melt and adapted to the shape of the discharge opening and prevented the premature discharge of the melt. After attainment of the required temperature in the melt, the plug member (protective tube of the thermocouple) was withdrawn and excess pressure was applied immediately subsequent thereto in order to express the melt through the nozzle opening. An argon atmosphere with an excess pressure of 0.18 bar was utilized. The molten metal stream struck the surface of a moving cooling drum composed of oxygen-free copper, which was positioned 0.2 mm away from the nozzle opening. The cooling drum utilized had a diameter of 42 cm. The cooling drum was rotated at a velocity of approximately 1400 rpm so that the linear velocity of the cooling drum surface was approximately 30 m/s. The metallic melt expressed through the nozzle opening solidified on the surface of the cooling drum to form a tape 3 mm wide and 0.04 mm thick. X-ray difraction measurements showed that the so-manufactured tape was substantially completely amorphous. Upon examination of the tape geometry, an extremely uniform width and thickness was noted over the entire length of the tape.

EXAMPLE 2

The procedure set forth in Example 1 was repeated, except that the circumferential velocity of the cooling drum was increased to 48 m/s. The amorphous tape produced by this variation was 3 mm wide and had a thickness of 0.03 mm.

EXAMPLE 3

The process of Example 1 was repeated, except that the quartz crucible was provided with a nozzle opening having a circular cross-section, whose diameter was 3 mm. Further, the circumferential velocity of the cooling drum was increased to 60 m/s and the discharge pressure was adjusted to 0.13 bar. The so-produced amorphous tape was 3 mm wide and had a thickness of 0.022 mm.

EXAMPLE 4

Utilizing operating conditions which were otherwise identical to those set forth in Example 1, a supply container with a circular nozzle opening having a diameter of 4 mm was provided and the circumferential velocity of the cooling drum was adjusted to 50 m/s. The amorphous tape manufactured with these parameters was 5 mm wide and 0.04 mm thick.

EXAMPLE 5

The procedure of Example 1 was repeated except that a circular nozzle opening having a diameter of 1.5 mm was utilized. Further, the circumferential velocity of the cooling drum was reduced to 20 m/s. The amorphous metal tape so-obtained had a width of 2 mm and a thickness of 0.04 mm.

EXAMPLE 6

The procedure of Example 1 was repeated except that the quartz crucible was provided with a circular nozzle opening having a 5.5 mm diameter, the discharge pressure was adjusted to 0.13 bar and the velocity of the cooling drum surface was adjusted to 30 m/s. The amorphous tape so-produced was 7 mm wide and 0.05 mm thick.

EXAMPLE 7

The procedure of Example 1 was repeated except that a quartz crucible having a circular nozzle opening with a diameter of 6 mm was utilized. Further, the discharge pressure was reduced to 0.06 bar and the circumferential velocity of the cooling drum was adjusted to 45 m/s. The so-expressed molten stream solidified to form an amorphous tape which was 6 mm wide and 0.04 mm thick.

EXAMPLE 8

The process of Example 1 was repeated, except that instead of a cooling drum composed of pure copper, a cooling drum of the same diameter but composed of copper/beryllium alloy with approximately 1.7 weight percent beryllium, was employed. This alloy has a thermal-conductivity of 1.13 W/cm.°K, which is smaller than that of pure copper by approximately a factor of 3. Due to the lower solidification velocity of the melt on this cooling drum surface, an amorphous tape was obtained having a width of 3 mm but whose thickness was only 0.03 mm.

EXAMPLE 9

An amorphous metal tape was produced from an alloy having a composition of $Fe_{40}Ni_{40}B_{20}$ in a crucible composed of boron nitride. This crucible was provided at its lower end with a nozzle having an opening of rectangular cross-section which had a width of 2.5 mm in the direction of motion of the cooling body surface and a longitudinal dimension perpendicular thereto of 10 mm. The moving cooling drum surface was positioned at a distance of 0.15 mm from the crucible opening and its circumferential velocity was adjusted to approximately 30 m/s. A gas pressure of 0.12 bar was provided above the melt. The expressed molten stream solidified into an amorphous tape which was 10 mm wide and had a thickness of 0.04 mm.

EXAMPLE 10

Utilizing the same operating parameters as set forth in Example 9, an alloy having the composition of $Co_{75}Si_{15}B_{10}$ was heated to approximately 1200° C. before it was expressed. The so-produced amorphous metal tape was 10 mm wide and 0.04 mm thick.

EXAMPLE 11

Example 9 was repeated, except that the crucible was provided with a nozzle having a rectangular discharge opening whose width in the direction of motion of the cooling body was 2 mm and whose length perpendicular thereto was 20 mm. The tape manufactured with this nozzle opening was 20 mm wide and 0.035 mm thick. This tape was subjected to X-ray difraction measurements and it was determined that its structure was completely amorphous.

The principles of the invention can be adapted for use in air, in a vacuum, or in any other suitable atmosphere such as, for example, an inert gas atmosphere. If one desires to avoid an oxidizing attack on a surface of the amorphous metal tape being produced, it is advantageous to form such tape in a vacuum or under an inert gas, upon exclusion of air.

The foregoing is considered as illustrative only on the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

We claim:

1. In a method of producing amorphous metal tapes wherein a metallic melt is expressed from a supply container through a nozzle having at least one nozzle opening defined therein and is allowed to solidify on a surface of a cooling body positioned in close proximity to and travelling in a direction of motion past the nozzle opening at a rate sufficient to produce an amorphous metal tape, the improvement comprising, in combination, moving said cooling body surface at a velocity of at least 5 m/s past said nozzle opening;

providing a nozzle having at least one nozzle opening with a width dimension of 1.5 to about 6 mm, as measured in the direction of motion of said cooling body surface; and maintaining a distance of about 0.005 to about 0.6 times the width of said nozzle opening between said cooling body surface and said nozzle opening.

2. In a method as defined in claim 1, wherein moving said cooling body surface occurs at a velocity in the range of 20 to about 40 m/s, providing said nozzle opening with a width dimension of 2 to about 4 mm, and maintaining said distance between said cooling body surface and said nozzle opening smaller than about 0.1 times the width of said nozzle opening.

3. A device for producing amorphous metal tapes, comprising, in combination:

(a) a cooling body having a casting surface which rotates about at least one axis thereof in a direction of motion;

(b) means associated with the cooling body for providing a metallic melt to the casting surface, including a supply container and a nozzle in fluid communication therewith; and (c) said nozzle having an opening therein positioned in relatively close proximity to such surface;

said nozzle opening having a width dimension of 1.5 to about 6 mm, as measured in the direction of motion of said cooling body surface, said cooling body surface being maintained at a distance of about 0.005 times to about 0.6 times the width of said nozzle opening from said nozzle opening, and said cooling body surface being moved at a velocity of at least 5 m/s past said nozzle opening.

4. A device as defined in claim 4 wherein said nozzle opening has a width dimension of 2 to about 4 mm, as measured in the direction of motion of said cooling body surface, said cooling body surface is maintained at a distance less than about 0.1 times the width of said nozzle opening from said nozzle opening and said cooling body surface is moved at a velocity in the range of 20 to about 40 m/s past said nozzle opening.

5. A device as defined in claim 3 wherein said nozzle opening has an approximately circular cross-section.

6. A device as defined in claim 4 wherein a moveable plug member is operationally associated with said nozzle opening for selectively opening and closing said opening.

7. A device as defined in claim 6 wherein said moveable plug member comprises a protective tube of a thermocouple immersible into the metallic melt.

* * * * *